US005685804A

United States Patent [19]

Whan-Tong et al.

[11] Patent Number: 5,685,804

[45] Date of Patent: Nov. 11, 1997

[54] STATIONARY EXERCISE DEVICE

[75] Inventors: Janine Whan-Tong, Woodinville; Peter Pasero, Renton; Paul D. Barker, Woodinville, all of Wash.

[73] Assignee: Precor Incorporated, Bothell, Wash.

[21] Appl. No.: 670,515

[22] Filed: Jun. 27, 1996

Related U.S. Application Data

[63] Continuation-in-part of Ser. No. 568,499, Dec. 7, 1995.

[51] Int. Cl.[6] ..... A63B 69/16; A63B 22/04

[52] U.S. Cl. ..... 482/51; 482/57; 482/908

[58] Field of Search ..... 482/51, 52, 53, 482/95, 96, 148, 70, 71, 56, 57, 908

[56] References Cited

U.S. PATENT DOCUMENTS

| | | |
|---|---|---|
| 219,439 | 9/1879 | Blend . |
| D. 330,236 | 10/1992 | Jarriel et al. . |
| 518,757 | 5/1894 | Hoyt . |
| 1,323,004 | 11/1919 | Boyd . |
| 2,603,486 | 7/1952 | Hughes . |
| 2,641,249 | 6/1953 | Brockman . |
| 2,826,192 | 3/1958 | Mangas . |
| 2,892,455 | 6/1959 | Hutton . |
| 3,316,898 | 5/1967 | Brown . |
| 3,432,164 | 3/1969 | Deeks . |
| 3,475,021 | 10/1969 | Ruegsegger . |
| 3,566,861 | 3/1971 | Weiss . |
| 3,713,438 | 1/1973 | Knutsen . |
| 3,759,511 | 9/1973 | Zinkin et al. . |
| 3,824,994 | 7/1974 | Soderberg, Sr. . |
| 4,053,173 | 10/1977 | Chase, Sr. . |
| 4,185,622 | 1/1980 | Swenson . |
| 4,188,030 | 2/1980 | Hooper . |
| 4,379,566 | 4/1983 | Titcomb . |
| 4,456,276 | 6/1984 | Bortolin . |
| 4,505,473 | 3/1985 | Pro . |
| 4,509,742 | 4/1985 | Cones . |
| 4,555,109 | 11/1985 | Hartmann . |
| 4,561,318 | 12/1985 | Schirrmacher . |
| 4,645,200 | 2/1987 | Hix . |
| 4,679,786 | 7/1987 | Rodgers . |
| 4,720,093 | 1/1988 | Del Mar . |
| 4,779,863 | 10/1988 | Yang . |
| 4,786,050 | 11/1988 | Geschwender . |
| 4,842,268 | 6/1989 | Jenkins . |
| 4,869,494 | 9/1989 | Lambert, Sr. . |
| 4,900,013 | 2/1990 | Rodgers, Jr. . |
| 4,949,954 | 8/1990 | Hix . |
| 4,949,993 | 8/1990 | Stark et al. . |
| 4,986,261 | 1/1991 | Iams et al. . |
| 4,989,857 | 2/1991 | Kuo . |
| 5,038,758 | 8/1991 | Iams et al. . |

(List continued on next page.)

FOREIGN PATENT DOCUMENTS

| | | |
|---|---|---|
| 0206208 | 7/1937 | Switzerland . |

OTHER PUBLICATIONS

Screen shot of TV infomercial regarding Body Strider from Body by Jake (screen shot undiscennable).

*Primary Examiner*—Stephen R. Crow
*Attorney, Agent, or Firm*—Christensen O'Connor Johnson & Kindness PLLC

[57] ABSTRACT

An exercise device includes a pair of foot engaging links (30*a*, 30*b*). The rearward ends of the foot links are supported for rotational motion about a pivot axis (26), and the forward ends of the foot links reciprocate back and forth along a guide (36). The combination to these two foot link motions permits the users feet to travel along an elliptical path of travel. The inclination and/or elevation of the guide (36) may be selectively altered to vary the nature of the stepping motion experienced by the user. At lower inclinations/elevations of the guide, the stepping motion may resemble cross country skiing. At progressively higher angles of inclination or elevations of the guide (36), the stepping motions may simulate walking, jogging, running and climbing. The connection of the foot links to the pivot axis allow motion in a direction orthogonal to the rotational motion, thus compensating for alignment inconsistencies of the device.

38 Claims, 14 Drawing Sheets

U.S. PATENT DOCUMENTS 5,039,087 8/1991 Kuo .
5,039,088 8/1991 Shifferaw .
5,131,895 7/1992 Rogers, Jr. .
5,135,447 8/1992 Robards, Jr. et al. .
5,149,312 9/1992 Croft et al. .
5,169,363 12/1992 Campanaro et al. ..... 482/96
5,186,697 2/1993 Rennex .
5,242,343 9/1993 Miller .
5,269,736 12/1993 Roberts ..... 482/56
5,279,529 1/1994 Eschenbach .
5,279,530 1/1994 Hess .
5,290,211 3/1994 Stearns .
5,295,928 3/1994 Rennex .
5,299,993 4/1994 Habing .
5,352,169 10/1994 Eschenbach .
5,383,829 1/1995 Miller .
5,401,226 3/1995 Stearns .
5,403,255 4/1995 Johnston .
5,423,729 6/1995 Eschenbach .
5,499,956 3/1996 Habing et al. .
5,518,473 5/1996 Miller .
5,527,246 6/1996 Rodgers, Jr. .
5,529,555 6/1996 Rodgers, Jr. .

STATIONARY EXERCISE DEVICE

CROSS REFERENCE TO RELATED APPLICATIONS

The present application is a continuation-in-part of co-pending application Ser. No. 08/568,499 filed on Dec. 7, 1995.

FIELD OF THE INVENTION

The present invention relates to exercise equipment, and more specifically to a stationary exercise device for simulating a range of stepping motions, including skiing, walking, jogging, running and climbing.

BACKGROUND OF THE INVENTION

The benefits of regular aerobic exercise has been well established and accepted. Because of inclement weather, time constraints and for other reasons, it is not possible to always walk, jog or run outdoors or swim in a pool. As such, various types of exercise equipment have been developed for aerobic exercise. For example, cross country skiing exercise devices simulate the gliding motion of cross country skiing. Such machines provide a good range of motion for the muscles of the legs. Treadmills are also utilized by many people for walking, jogging or even running. One drawback of most treadmills is that during jogging or running, significant jarring of the hip, knee, ankle and other joints of the body may occur. Another type of exercise device simulates stair climbing. Such devices can be composed of foot levers that are pivotally mounted to a frame at their forward ends and have foot receiving pads at their rearward ends. The user pushes his/her feet down against the foot levers to simulate stair climbing. Resistance to the downward movement of the foot levers is provided by springs, fluid shock absorbers and/or other elements.

The aforementioned devices exercise different muscles of the user's legs and other parts of the body. Thus, to exercise all of these muscles, three separate exercise apparatus are needed. This not only may be cost prohibitive, but also many people do not have enough physical space for all of this equipment. Further, if only one of the foregoing exercise apparatus is purchased by a user, the user may tire of always utilizing the singular equipment and may desire to use other types of equipment.

Through the present invention, a singular piece of equipment may be utilized to simulate different exercise apparatus, including cross country skiing, walking, jogging, running and climbing. Further, jogging and running are simulated without imparting shock to the user's body joints in the manner of exercise treadmills.

These and other advantages of the present invention will be readily apparent from the drawings, discussion and description which follow.

SUMMARY OF THE INVENTION

The exercise device of the present invention utilizes a frame configured to be supported on a floor. The frame defines a rearward pivot axis about which first and second foot links are coupled to travel along an arcuate path relative to the pivot axis. The foot links, adapted to support the user's feet, have forward ends that are engaged with a guide mounted on the frame to enable the forward ends of the foot links to travel back and forth along a defined path. The angular elevation of the guide and/or the elevation of the guide relative to the frame may be selectively changed to alter the path traveled by the foot supporting portion of the first and second links thereby to simulate various types of stepping motion.

In a more specific aspect of the present invention, the guide includes rails for receiving and guiding the forward ends of the foot links. The rails may be raised and lowered relative to the frame. For example, the guides may be pivotally mounted on the frame, and the angle of inclination of the guides may be selectively altered.

In a yet more specific aspect of the present invention, the guides may be in the form of tracks that engage with the forward ends of the foot links. The elevation and/or angular orientation of the tracks relative to the frame may be selectively changed thereby to alter the types of stepping motion experienced by the user.

In another aspect of the present invention, the guide for the forward ends of the foot links may include one or more pivot or rocker arms pivotally supported by the frame, with the lower ends of the rocker arms pivotally connected to the forward ends of the foot links. The lengths of the rocker arms may be lengthened or shortened thereby to raise and lower the connection point between the rocker arms and the forward ends of the foot links, thereby to change the type of stepping motion experienced by the user.

In a further aspect of the present invention, flywheels are mounted on a rearward portion of the time to rotate about the frame pivot axis. The rearward ends of the foot links are pivotally pinned to the flywheels at a selective location from the frame pivot axis. The flywheel serves not only as the coupling means between the rearward ends of the foot links and the frame pivot axis, but also as a momentum storing device to simulate the momentum of the body during various stepping motions.

According to a further aspect of the present invention, resistance may be applied to the rotation of the flywheels, to make the stepping motion harder or easier to achieve. This resistance may be coordinated with the workout level desired by the user, for instance, a desired heart rate range for optimum caloric expenditure. A heart rate monitor or other sensor may be utilized to sense the desired physical parameter to be optimized during exercise.

In a still further aspect of the present invention, the rearward end of the foot links are connected to the pivot axis by a connection system that allows relative pivoting motion between the pivot axis and foot links about two axes, both orthogonal (transverse) to the length of the foot links. As such, the forward ends of the foot links are free to move or shift relative to the rearward ends of the foot links in the sideways direction, i.e., traverse to the length of the foot links.

BRIEF DESCRIPTION OF THE DRAWINGS

The foregoing aspects and many of the advantages of the present invention will be more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
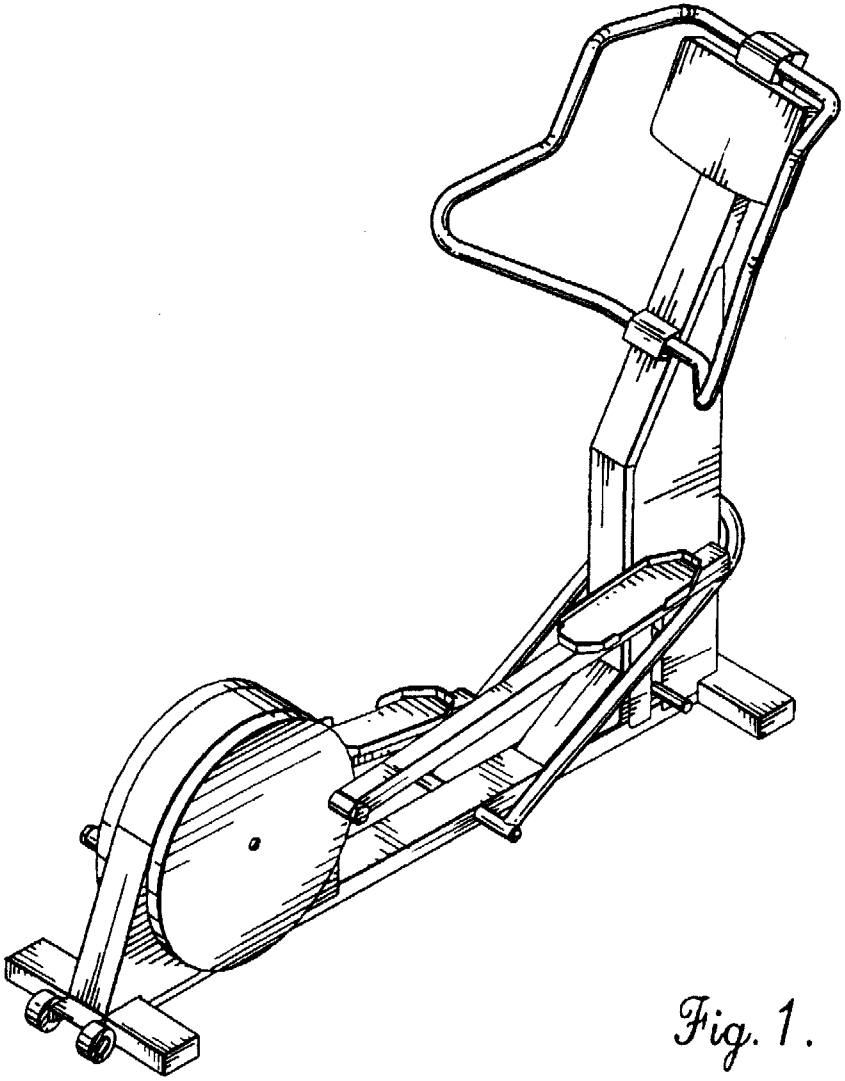
FIG. 1 is a perspective view of an exercise apparatus of the present invention looking from the rear toward the front of the apparatus.
Figure 3:
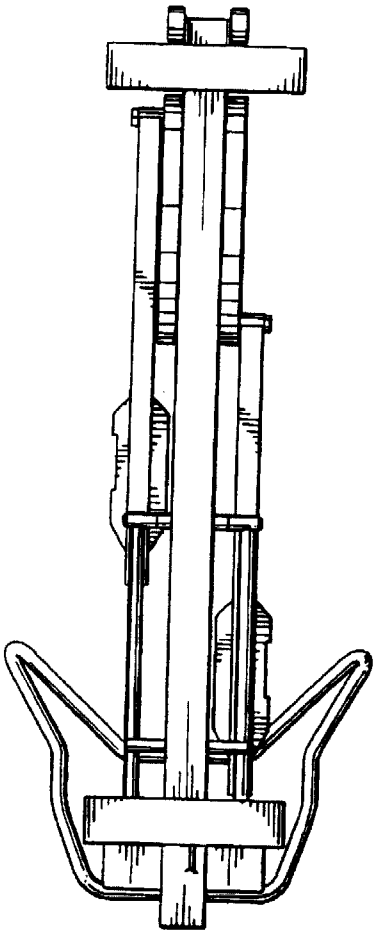
FIG. 3 is a bottom view of the apparatus of FIG. 1.
Figure 2:
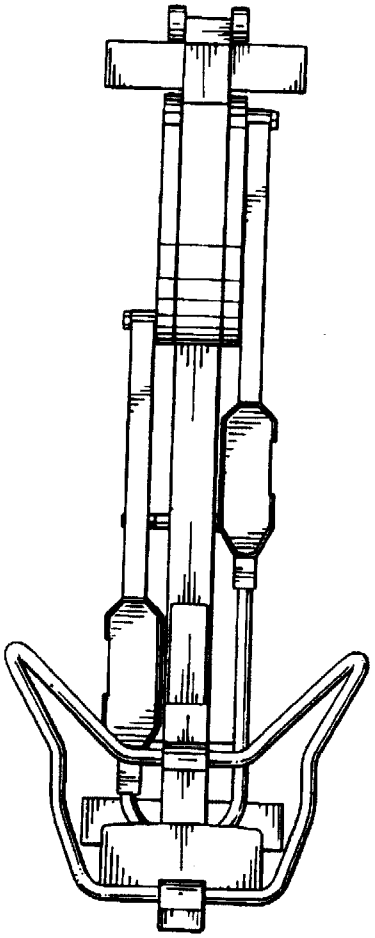
FIG. 2 is a top view of the apparatus of FIG. 1.
Figure 5:
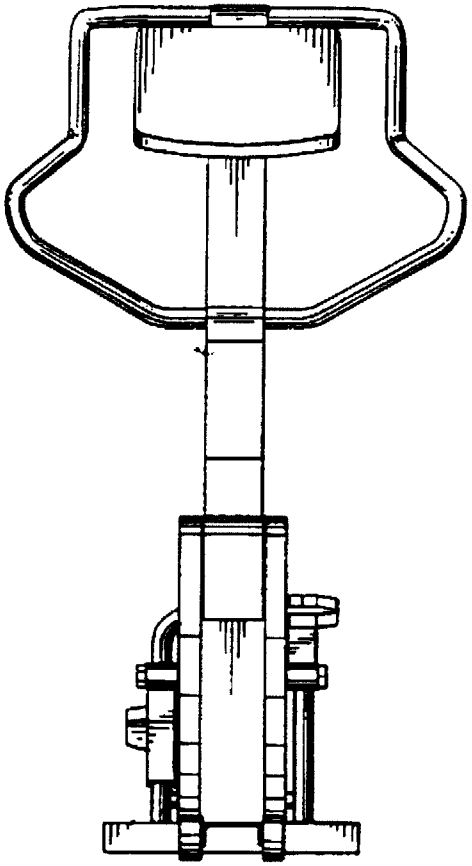
FIG. 5 is a rear view of the apparatus of FIG. 1.
Figure 4:
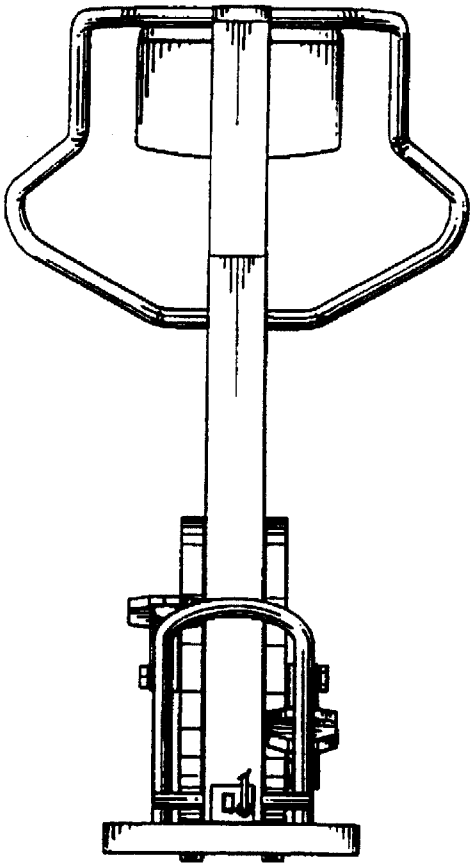
FIG. 4 is a front view of the apparatus of FIG. 1.
Figure 6:
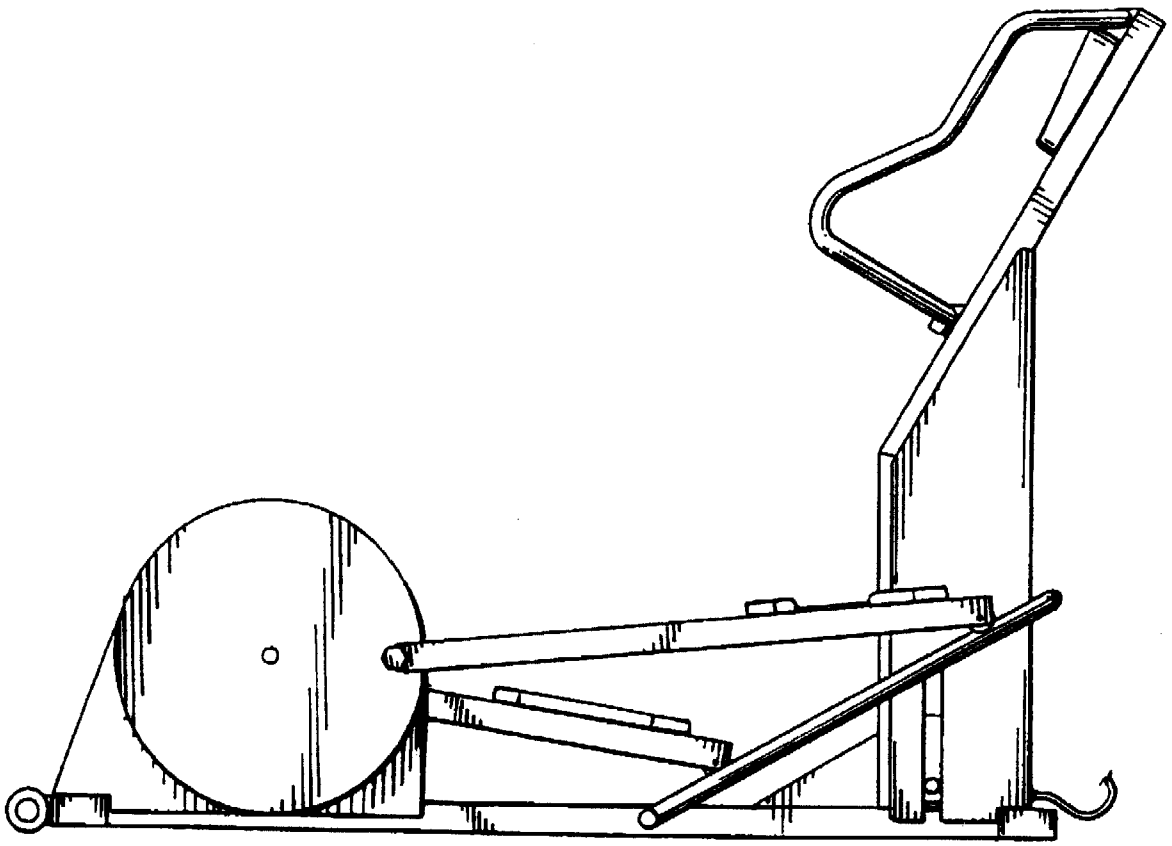
FIG. 6 is side elevational view of the apparatus of FIG. 1.
Figure 7:
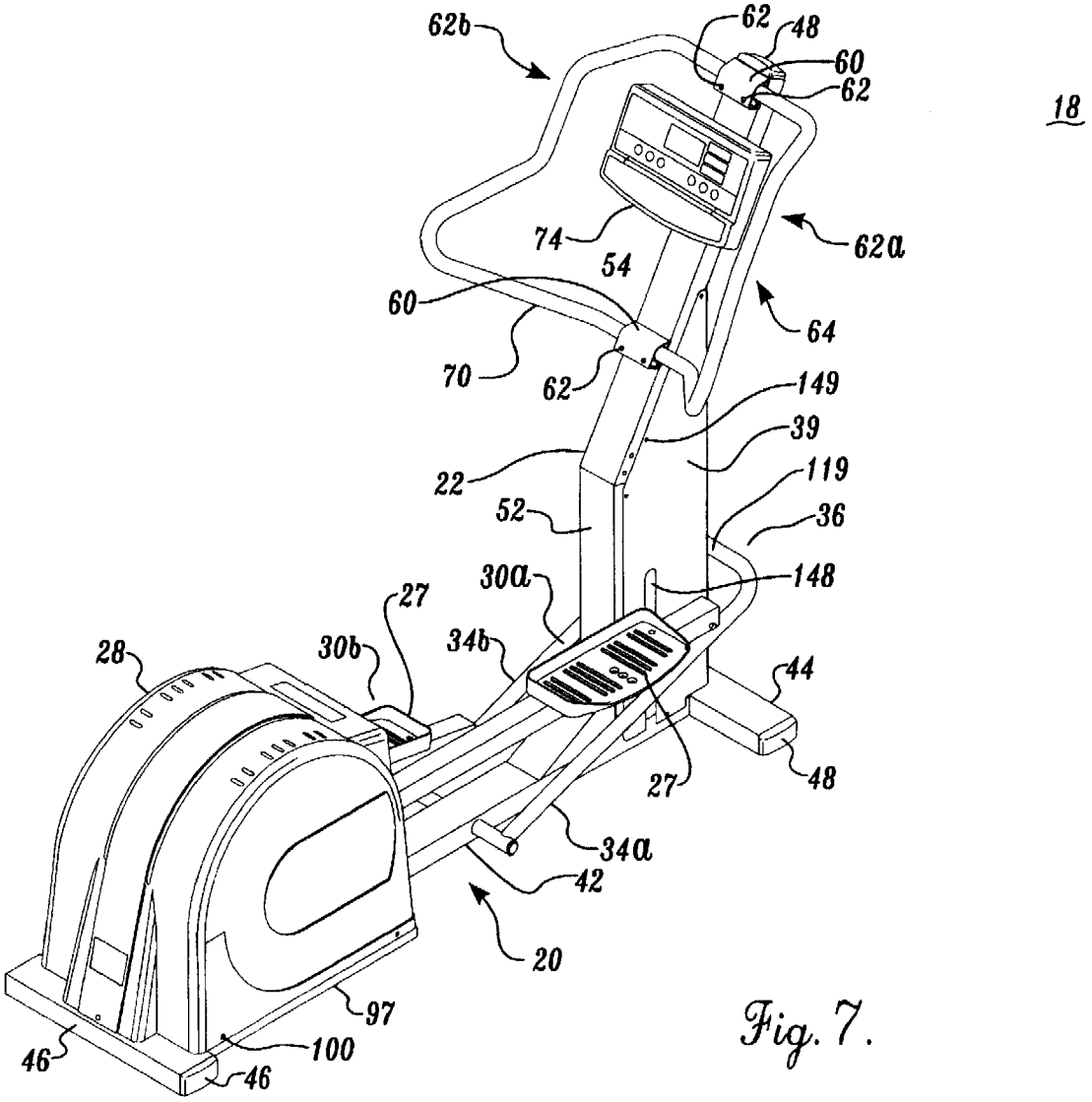
FIG. 7 is a perspective view of the apparatus of FIG. 1, wherein a hood has been installed over the rear portion of the apparatus, this perspective view looks from the rear of the apparatus towards the front.
Figure 8:
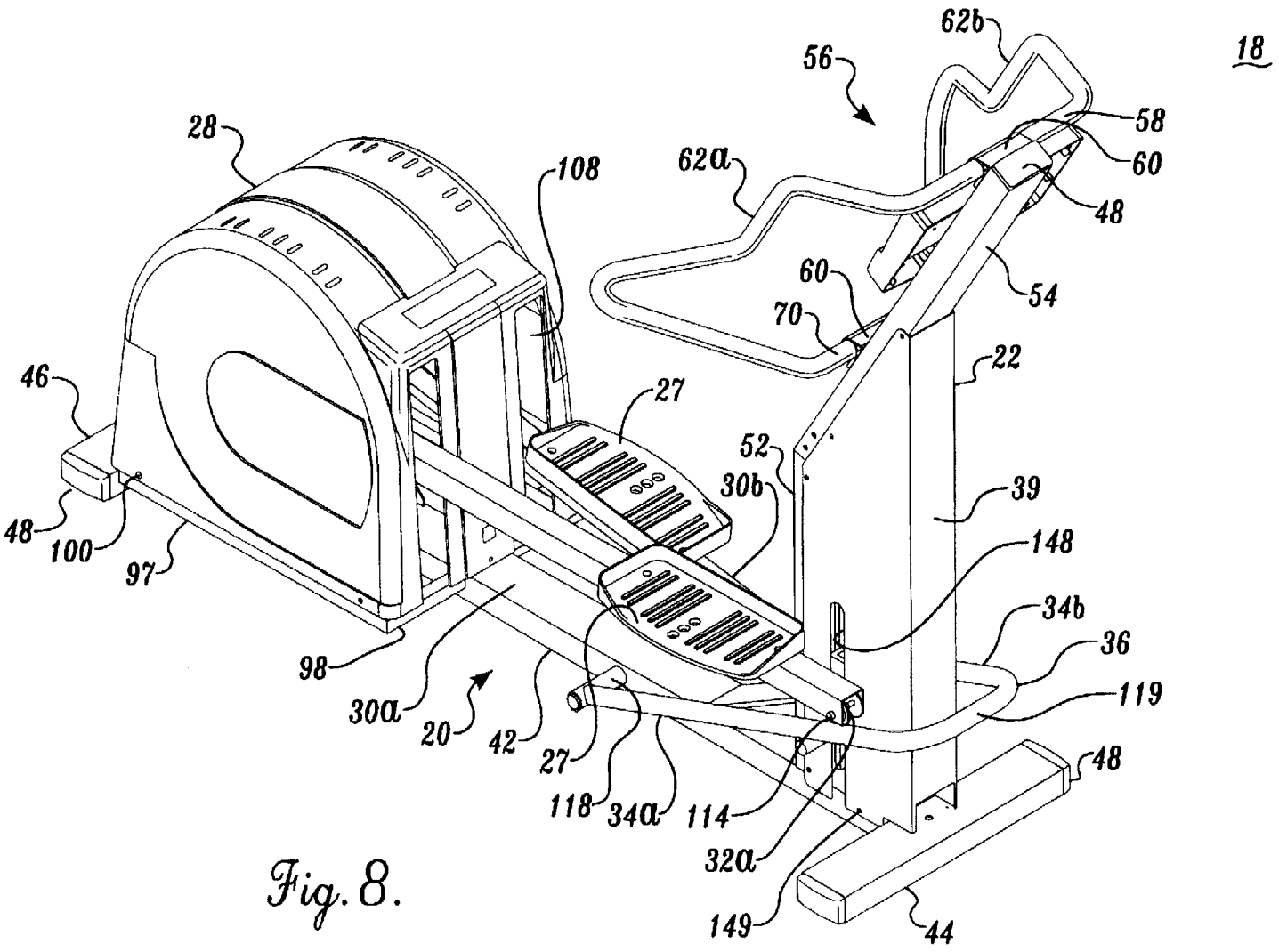
FIG. 8 is a view similar to FIG. 7, but looking from the front of the apparatus towards the rear.

Referring initially to FIGS. 1–9, the apparatus 18 of the present invention includes a floor engaging frame 20 incorporating a forward post 22 extending initially upwardly and then diagonally forwardly. A pair of flywheels 24a and 24b are located at the rear of the frame 20 for rotation about a horizontal, transverse axis 26. The flywheels 24a and 24b may be covered by a rear hood 28. The rearward ends of foot links 28a and 28b are pivotally attached to corresponding flywheels 24a and 24b to travel about a circular path around axis 26 as the flywheels rotate. Rollers 32a and 32b are rotatably mounted to the forward ends of foot links 30a and 30b to ride along corresponding tubular tracks 34a and 34b of a guide 36. The forward ends of the foot links 30a and 30b reciprocate back and forth along tracks 34a and 34b as the rearward ends of the foot links rotate about axis 26 causing the foot pedals or pads 27 carded by the foot links to travel along various elliptical paths, as described more fully below.

A lift mechanism 38, mounted on the post 22, is operable to selectively change the inclination of the guide 36 thereby to alter the stepping motion of the user of the apparatus of the present invention. At a low angle of inclination, the apparatus provides a cross country skiing motion and as the angle of inclination progressively rises, the motion changes from walking to running to climbing. A forward hood 39 substantially encases the lift mechanisms.

Figure 11:
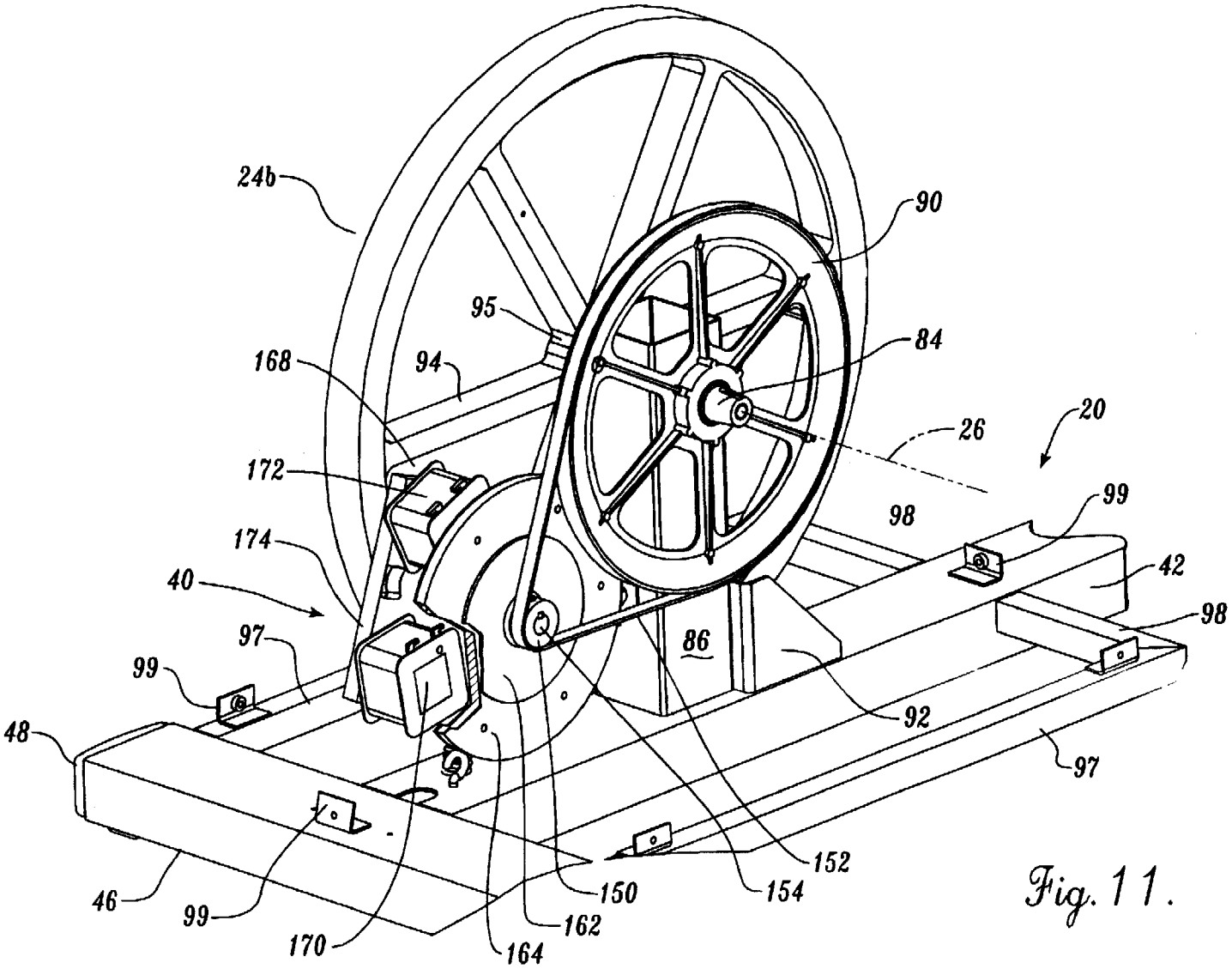
FIG. 11 is an enlarged, fragmentary, rear perspective view of the apparatus shown in FIG. 9, with one of the flywheels removed.
Figure 12:
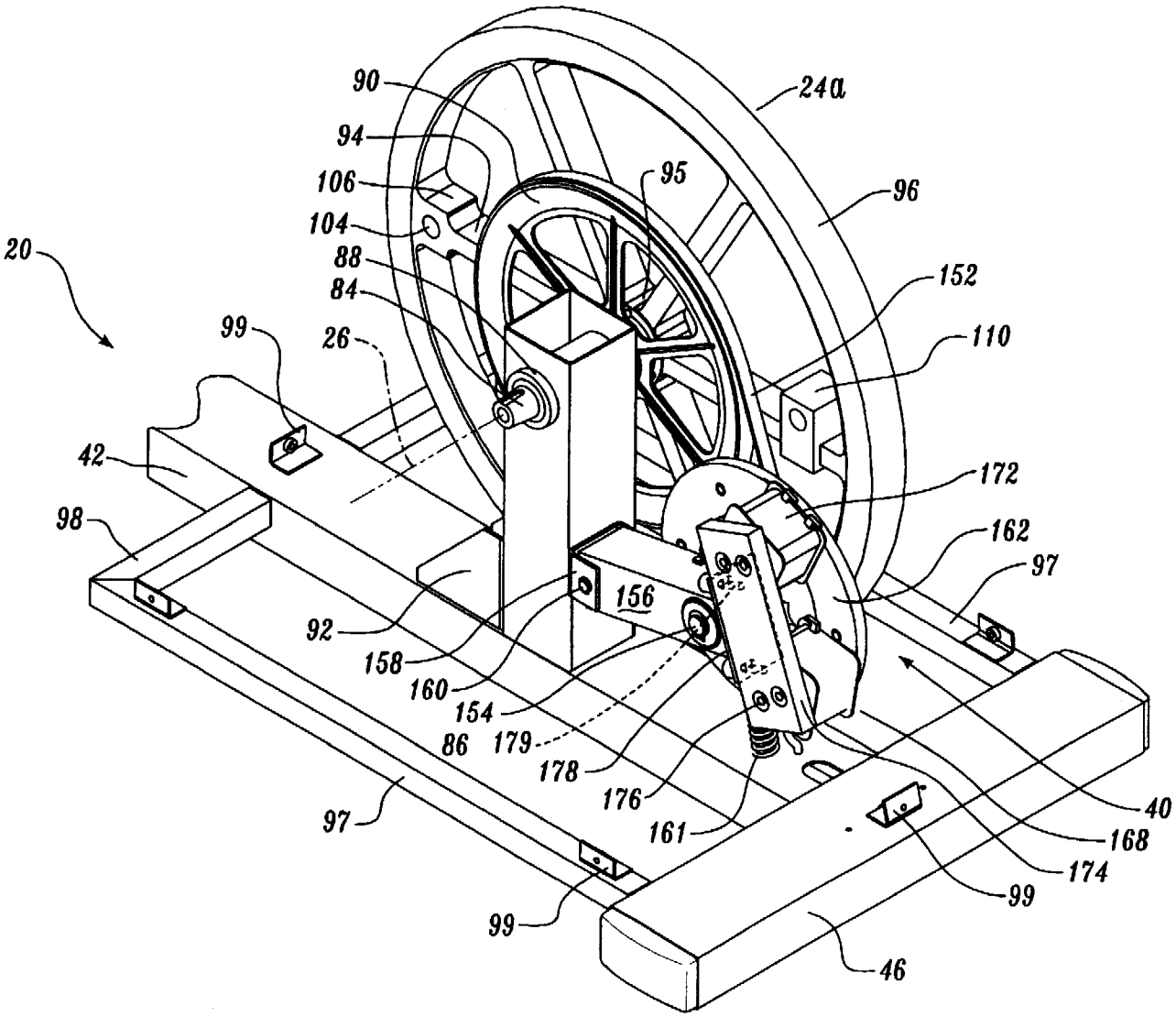
FIG. 12 is a view similar to FIG. 11, but from the opposite side of the apparatus and with the near flywheel removed.

In addition, as most clearly shown in FIGS. 11 and 12, the present invention employs a braking system 40 for imparting a desired level of resistance to the rotation of flywheels 24a and 24b, and thus, the level of effort required of the user of apparatus 18. The following description describes the foregoing and other aspects of the present invention in greater detail.

Frame 20 is illustrated as including a longitudinal central member 42 terminating at front and rear relatively shorter transverse members 44 and 46. Ideally, but not essentially, the frame 20 is composed of rectangular tubular members, which are relatively light in weight but provide substantial strength. End caps 48 are engaged within the open ends of the transverse members 44 and 46 to close off the ends of these members.

The post structure 22 includes a lower, substantially vertical section 52 and an upper section 54 that extends diagonally upwardly and forwardly from the lower section. Ideally, but not essentially, the post lower and upper sections 52 and 54 may also be composed of rectangular tubular material. An end cap 48 also engages within the upper end of the post upper section 54 to close off the opening therein.

A continuous, closed form handle bar 56 is mounted on the upper portion of post upper section 54 for grasping by an individual while utilizing the present apparatus 18. The handle bar includes an upper transverse section 58 which is securely attached to the upper end of the post upper section 54 by a clamp 60 engaging around the handle bar upper section and securable to the post upper section by a pair of fasteners 62. The handle bar also includes side sections 62a and 62b each composed of an upper diagonally disposed section, an intermediate, substantially vertical section and lower diagonally disposed sections 68a and 68b extending downwardly and flaring outwardly from the intermediate side sections. The handle bar 56 also includes a transverse lower section 70 having a central portion clamped to post upper section 54 by a clamp 60, which is held in place by a pair of fasteners 62. Although not shown, the handle bar 56 may be in part or in whole covered by a gripping material or surface, such as tape, foamed synthetic rubber, etc.

A display panel 74 is mounted on the post bar upper section 54 at a location between the upper and lower transverse sections 58 and 70 of the handle bar 56. The display panel includes a central display screen 76 and several smaller screens 78 as well as a keypad composed of a number of depressible "buttons" 80, as discussed in greater detail below.

The flywheels 24a and 24b are mounted on the outboard, opposite ends of a drive shaft 84 rotatably extending transversely through the upper end of a rear post 86 extending upwardly from a rear portion of the frame central member 42. A beating assembly 88 is employed to anti-frictionally mount the drive shaft 84 on the rear post 86. In a preferred embodiment of the present invention, the flywheels 24a and 24b are keyed or otherwise attached to the drive shaft 84 so that the flywheels rotate in unison with the drive shaft. It will be appreciated that the center of the drive shaft 84 corresponds with the location of transverse axis 26. A belt drive sheave 90 is also mounted on drive shaft 84 between flywheel 24a and the adjacent side of rear post 86.

The rear post 86 may be fixedly attached to frame longitudinal member 42 by any expedient manner, such as by welding or bolting. In accordance with a preferred embodiment of the present invention, a comer type brace 92 is employed at the juncture of the forward lower section of rear post 86 with the upper surface of longitudinal member 42 to provide reinforcement therebetween. Of course, other types of bracing or reinforcement may be utilized.

The flywheels 24a and 24b are illustrated as incorporating spokes 94 that radiate outwardly from a central hub 95 to intersect a circumferential rim 96. The flywheels 24a and 24b may be of other constructions, for instance, in the form of a substantially solid disk, without departing from the spirit or scope of the present invention.

The rear hood 28 encloses the flywheels 24a and 24b, the brake system 40 and the rear portions of the foot links 30a and 30b. The hood 28 rests on frame rear transverse member 46 as well as on a pair of auxiliary longitudinal members 97 extending forwardly from the transverse member 46 to intersect the outward ends of auxiliary intermediate transverse members 98. The upper surfaces of the hood support members 97 and 98 coincide with the upper surfaces of frame member 42 and 46. Also, a plurality of attachment brackets 99 are mounted on the upper surfaces of the auxiliary support members 97 and 98 as well as frame members 42 and 46. Threaded openings are formed in the brackets 99 to receive fasteners used to attach the hood 28 thereto. As most clearly illustrated in FIGS. 11 and 12, ideally in cross section the heights of hood support members 97 and 98 are shorter than the cross-sectional height of frame members 42 and 46 so as not to bear on the underlying floor.

The foot links 30*a* and 30*b* as illustrated are composed of elongate tubular members but can be of other types of construction, for example, solid rods. The rear ends of the foot links 30*a* and 30*b* pivotally pinned to outer perimeter portions of flywheels 24*a* and 24*b* by fasteners 100 that extend through collars 102 formed at the rear ends of the foot links to engage within apertures 104 formed in perimeter portions of the flywheels. As most clearly shown in FIG. 12, the aperture 104 is located at the juncture between flywheel spoke 94 and the outer rim 96. This portion of the flywheel has been enlarged to form a boss 106. The foot links 30*a* and 30*b* extend outwardly of the front side of hood 28 through vertical openings 108 formed in the front wall of the hood.

As also shown in FIG. 12, a second boss 110 is formed on the diametrically opposite spoke to the spoke on which boss 106 is located, but at a location closer to axis 26 than the location boss 106. The collars 102 at the rear ends of the foot links may be attached to the flywheels at bosses 110 instead of bosses 106, thereby reducing the diameter of the circumferential paths traveled by the rear ends of the foot links during rotation of the flywheel, and thus, correspondingly shortening the length of the elliptical path circumscribed by the foot pedals 27. It will be appreciated that attaching the collars 102 to bosses 110 results in a shorter stroke of the foot links, and thus, a shorter stride taken by the exerciser in comparison to the stride required when the collars are attached to the flywheels at bosses 106.

Concave rollers 32*a* and 32*b* are rotatably joined to the forward ends of the foot links 30*a* and 30*b* by cross shafts 114. The concave curvature of the rollers coincide with the diameter of the tracks 34*a* and 34*b* of the guide 36. As such, the rollers 32*a* and 32*b* maintain the forward ends of the foot links securely engaged with the guide 36 during use of the present apparatus. Foot receiving pedals 27 are mounted on the upper surfaces of the foot links 30 to receive and retain the user's foot. The pedals 27 are illustrated as formed with a plurality of transverse ridges that not only enhance the structural integrity of the foot pads, but also serve an anti-skid function between the bottom of the user's shoe or foot and the foot pedals. Although not shown, the foot pedals may be designed to be positionable along the length of the foot links to accommodate user's of different heights and in particular different leg lengths or in seams.

The guide 36 is illustrated as generally U-shaped with its rearward, free ends pivotally pinned to an intermediate location along the length of frame central member 42. The free ends of the guide 36 may be pivotally attached to the central frame member 42 by any convenient method, including by being journaled over the outer ends of a cross tube 118. The guide is composed of parallel, tubular tracks 34*a* and 34*b* disposed in alignment with the foot links 30*a* and 30*b*. The forward ends of the tracks 34*a* and 34*b* are joined together by an arcuate portion 119 that crosses the post 22 forwardly thereof.

Figure 9:
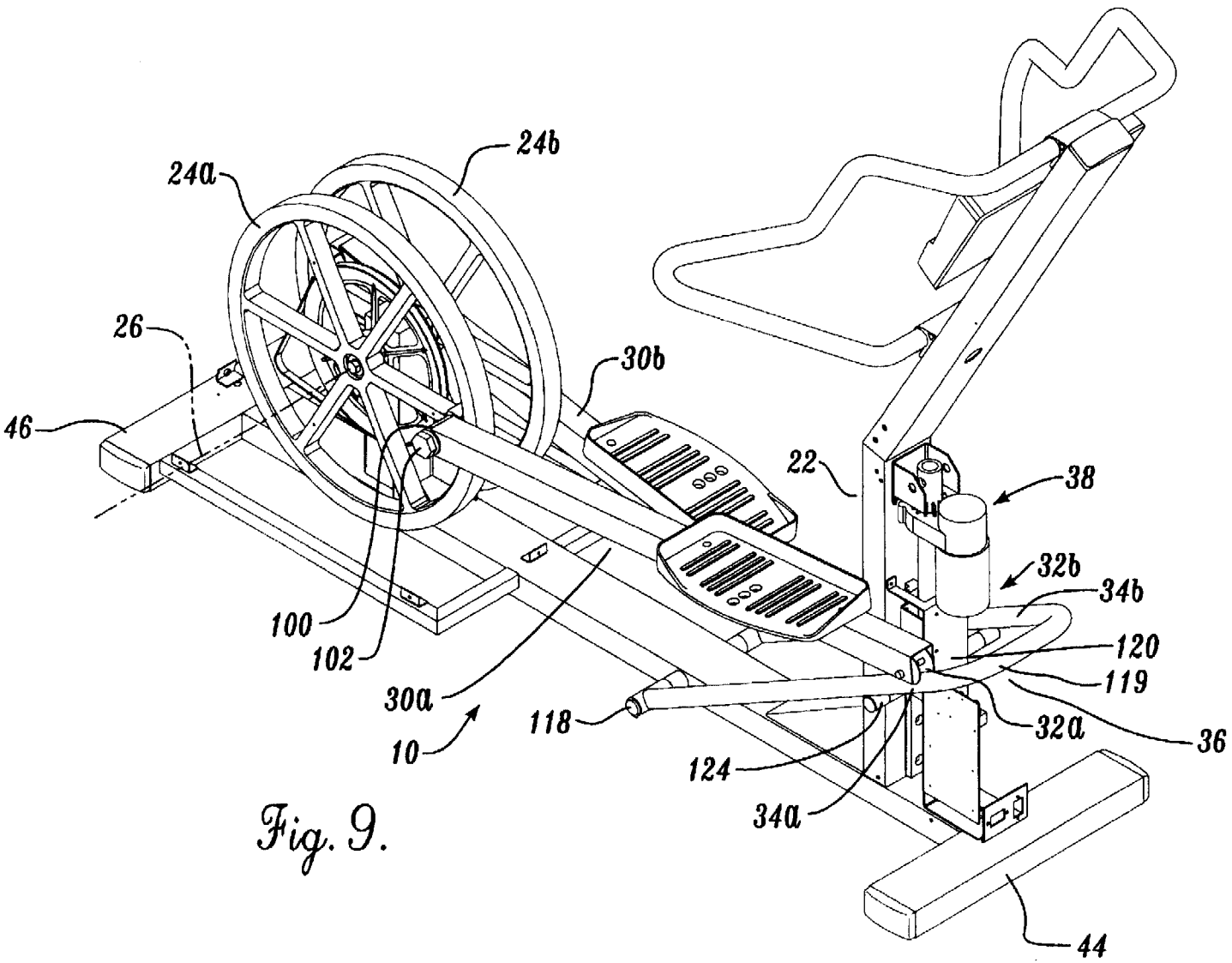
FIG. 9 is a view similar to FIG. 8, but with the front and rear hoods removed.
Figure 10:
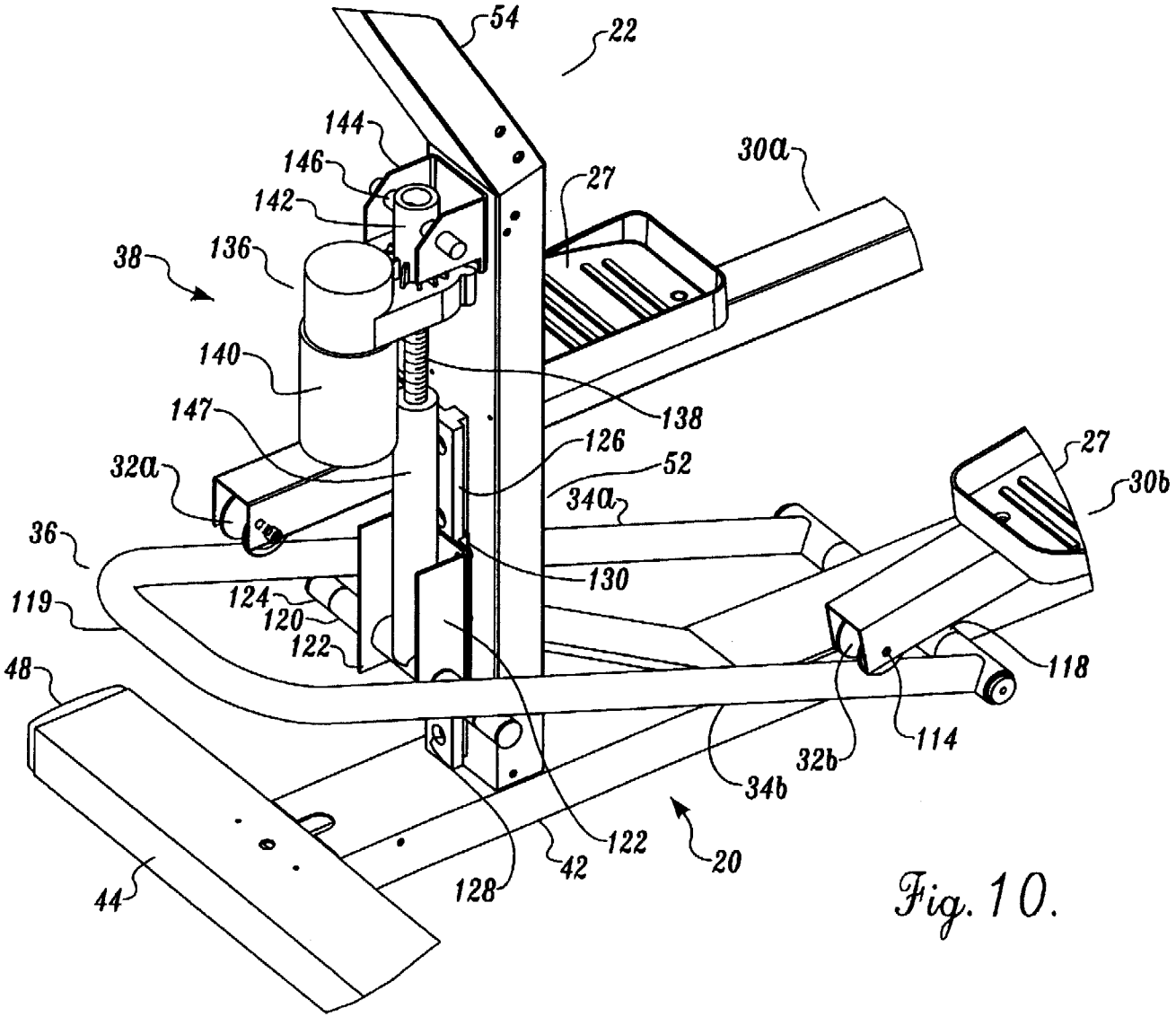
FIG. 10 is an enlarged, fragmentary, perspective view of the forward portion of the apparatus shown in FIG. 9.

The forward portion of the guide 36 is supported by lift mechanism 38, which is most clearly shown in FIGS. 9 and 10. The lift mechanism 38 includes a crossbar 120 supported by the lower end of a generally U-shaped, vertically movable carriage 122. Roller tube sections 124 are engaged over the outer ends of the crossbar 120 to directly underlie and bear against the bottoms of tracks 34*a* and 34*b*. The carriage 122 is restrained to travel vertically along the height of a central guide bar 126 which is securely fastened to the forward face of the post lower section 54 by any appropriate method, such as by fasteners 128. In cross section, the guide bar 126 is generally T-shaped, having a central web portion that bears against the post lower section 52 and transversely extending flange portions that are spaced forwardly of the post lower section. A pair of generally Z-shaped retention brackets 130 retain the carriage 122 in engagement with the guide bar 126. The retention brackets each include a first transverse flange section mounted to the back flange surface of the carriage, an intermediate web section extending along the outer side edges of the guide bar flanges and a second transverse flange section disposed within the gap formed by the front surface of the post lower section 52 and the opposite surface of the guide bar flange. It will be appreciated that by this construction the carriage 122 is allowed to vertically travel relative to the guide bar 126 but is retained in engagement with the guide bar.

The carriage 122 is raised and lowered by an electrically powered lift actuator 136. The lift actuator 136 includes an upper screw section 138 is rotatably powered by an electric motor 140 operably connected to the upper end of the screw section. The top of the screw section is rotatably engaged with a retaining socket assembly 142 which is pinned to a U-shaped bracket 144 secured to the forward face of post 22 near the juncture of the post lower section 52 and upper section 54. A cross pin 146 extends through aligned openings formed in the flanges of the bracket 144 and aligned diametrically opposed apertures formed in the socket 142. The socket 142 allows the screw 138 to rotate relative to the socket while remaining in vertical engagement with the collar.

The lower portion of the screw section 138 threadably engages within a lower tubular casing 147 having its bottom end portion fixedly attached to crossbar 120. It will be appreciated that motor 140 may be operable to rotate the screw section 138 in one direction to lower the carriage 122 or in the opposite direction to raise the carriage, as desired. As the carriage is lowered or raised, the angle of inclination of the guide 36 is changed which in turn changes the stepping motion experienced by the user of apparatus 18. The engagement of the screw section 138 into the casing 120, and thus the angle of inclination of the guide 36, is readily discernible by standard techniques, for instance by using a rotating potentiometer 147, FIG. 14.

The forward hood 39 substantially encases the lift mechanism 38. The hood 39 extends forwardly from the side walls of the post lower and upper sections 52 and 54 to enclose the carriage 122, guide bar 126, lift actuator 136 and other components of the lift mechanism. Only the free ends of the cross bar 120 and associated roller tube sections 124 protrude outwardly from vertical slots 148 formed in the side walls of the hood 39. A plurality of fasteners 149 are provided to detachably attach the hood 39 to the side walls of the post 22.

The present invention includes a system for selectively applying the braking or retarding force on the rotation of the flywheels through a eddy current brake system 40. The brake system 40 includes a larger drive sheave 90, noted above, that drives a smaller driven sheave 150 through a V-belt 152. The driven sheave 150 is mounted on the free end of a rotatable stub shaft 154 that extends outwardly from a pivot arm 156 pivotally mounted to the rear side of rear post 86 by a U-shaped bracket 158 and a pivot pin 160 extending through aligned openings formed in the bracket as well as aligned openings formed in the side walls of the pivot arm 156. An extension spring 161 extends between the bottom of arm 156 at the free end thereof and the top of frame member 42 to maintain sufficient tension on belt 152 to avoid slippage between the belt and the sheaves 90 and 150. The relative sizes of sheaves 90 and 150 are such as to achieve a step of speed at about six to ten times and ideally about eight times. In other words, the driven shaft 154 rotates about six to ten times faster than the drive shaft 84.

A solid metallic disk 162 is mounted on stub shaft 154 inboard of driven sheave 150 to also rotate with the driven sheave. Ideally, an annular face plate 164 of highly electrically conductive material, e.g., copper, is mounted on the face of the solid disk 162 adjacent the driven pulley 150. A pair of magnet assemblies 168 are mounted closely adjacent the face of the solid disk 162 opposite the annular plate 164. The assemblies 168 each include a central core in the form of a bar magnet 170 surrounded by a coil assembly 172. The assemblies 168 are mounted on a keeper bar 174 by fasteners 176 extending through aligned holes formed in the keeper bar and the magnet cores. As illustrated in FIGS. 11 and 12, the magnet assemblies 168 are positioned along the outer perimeter portion of the disk 162 in alignment with the annular plate 164. The location of the magnet assemblies may be adjusted relative to the adjacent face of the disk 162 so as to be positioned as closely as possible to the disk without actually touching or interfering with the rotation of the disk. This positioning of the magnet assemblies 168 is accomplished by adjusting the position of the keeper bar 174 relative to a support plate 178 mounted on the rearward, flee end of pivot arm 156. A pair of horizontal slots, not shown, are formed in the support plate 178 through which extend threaded fasteners 179 that then engage within tapped holes formed in the forward edge of the keeper bar 174.

As noted above, the significant difference in size between the diameters of drive sheave 90 and driven sheave 150 results in a substantial step up in rotational speed of the disk 62 relative to the rotational speed of the flywheels **24*a* and 24*b*. The rotational speed of the disk 62 is thereby sufficient to produce relatively high levels of braking torque through the eddy current brake assembly 40**.

As discussed more fully below, it is desirable to monitor the speed of the flywheels **24*a* and 24*b* so as to measure the distance traveled by the user of the present apparatus and also to control the level of workout experienced by the user. Any standard method of measuring the speed of the flywheels may be utilized. For instance, an optical or magnetic strobe wheel may be mounted on disk 162, drive sheave 90 or other rotating member of the present apparatus. The rotational speed of the strobe wheel may be monitored by an optical or magnetic sensor 180 (FIG. 14**) to generate an electrical signal related to such rotational speed.

Figure 13:
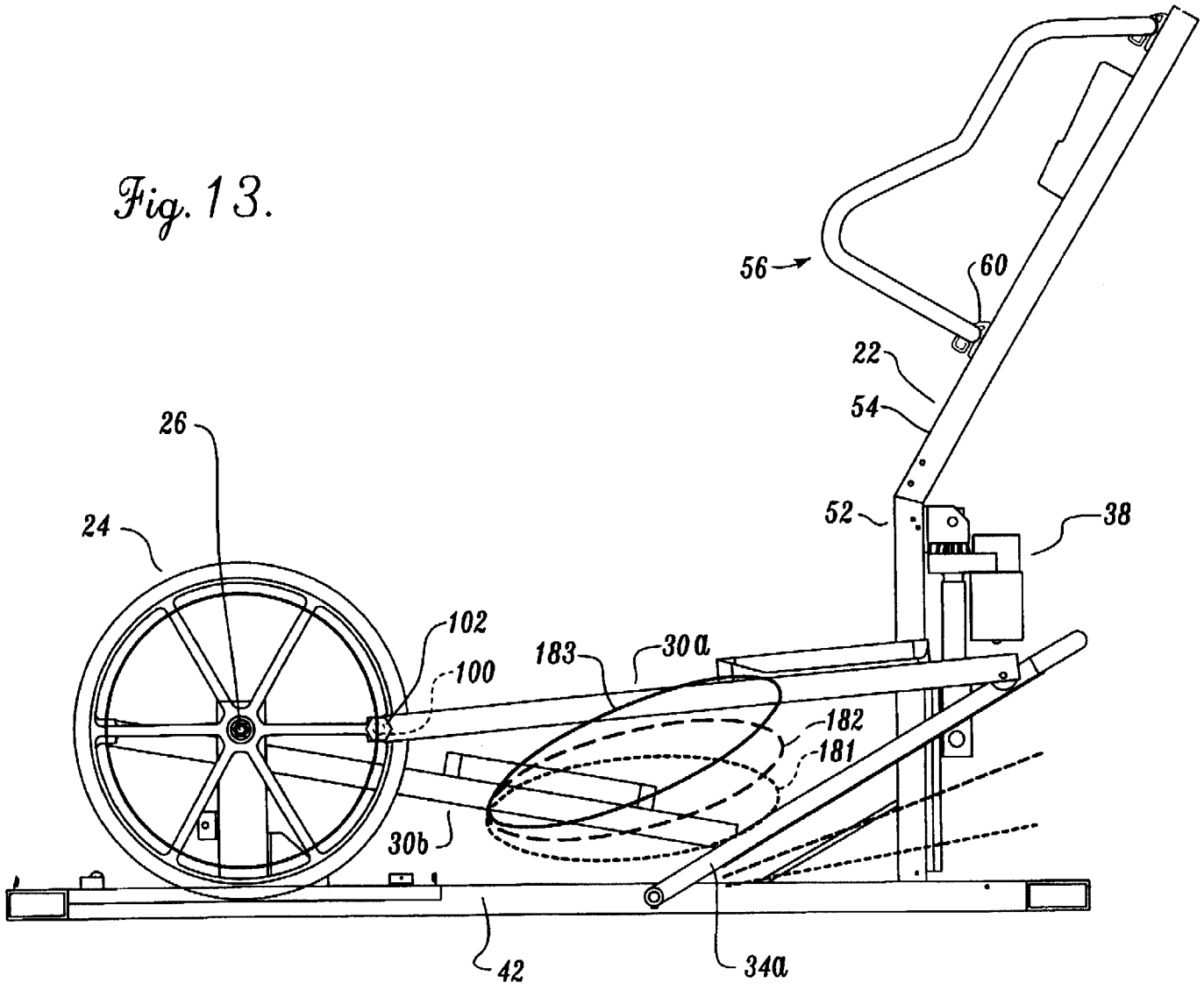
FIG. 13 is a side elevations view of the apparatus of the present invention shown in schematic illustrating the paths of the user's foot at different angles of inclination of the guide for the foot links.

To use the present invention, the user stands on the foot pads 27 while gripping the handle bar 56 for stability. The user imparts a downward stepping action on one foot pads thereby causing the flywheels **24*a* and 24*b* to rotate about axis 26. As a result, the rear ends of the foot links rotate about the axis 26 and simultaneously the forward ends of the foot links ride up and down the tracks 34*a* and 34*b*. The forward end of the foot link moves downwardly along its track as the point of attachment of the foot link to the flywheel moves from a location substantially closest to the post 22 (maximum extended position of the foot link) to a location substantially furthest from the post, i.e., the maximum retracted position of the foot link. From this point of the maximum retracted position of the foot link, further rotation of the flywheel causes the foot link to travel back upwardly and forwardly along the track 34*a* back to the maximum extended position of the foot link. These two positions are shown in FIG. 13. FIG. 13 also illustrates the corresponding path of travel of the center of the foot pads 27, and thus, the path of travel of the user's feet. As shown in FIG. 13**, this path of travel is basically in the shape of a forwardly and upwardly tilted ellipse.

FIG. 13 shows the path of travel of the foot pad 27 at three different angular orientations of guide 36 corresponding to different elevations of the lift mechanism 38. In the smallest angular orientation shown in FIG. 13 (approximately 10° above the horizontal), the corresponding foot pad travel path 181 is illustrated. This generally corresponds to a gliding or cross-country skiing motion. The guide 36 is shown at a second orientation at a steeper angle (approximately 20°) from the horizontal, with the corresponding path of travel, of the foot pedal 116 depicted by elliptical path 182. This path of travel generally corresponds to a walking motion. FIG. 13 also illustrates a third even steeper angular orientation of the guide 36, approximately 30° from the horizontal. The corresponding elliptical path of travel of the foot pad 27 is illustrated by 183 in FIG. 13. This path of travel corresponds to a climbing motion. It will be appreciated that by adjusting the angle of the guide 36, different types of motion are attainable through the present invention. Thus, the present invention may be utilized to emulate different types of physical activity, from skiing to walking to running to climbing. Heretofore to achieve these different motions, different exercise equipment would have been needed.

Applicants note that in each of the foregoing different paths of travel of the foot pad, and thus also the user's feet, a common relationship occurs. When the rear end of a foot link travels forwardly from a rearmost position, for instance, as shown in FIG. 13, the heel portion of the user's foot initially rises at a faster rate than the toe portion of the user's foot. Correspondingly, when the rearward end of the foot link travels rearwardly from a foremost position, the heel portion of the user's foot initially lowers at a faster rate than the toe portion. This same relationship is true when the forward ends of the foot links travel from a position at the lower end of the guide 36 to a position at the upper end of the guide 36. In other words, when the forward end of a foot link travels from a lower, rearmost point along guide 36 forwardly and upwardly along the guide, the heel portion of the user's foot initially rises at a faster rate than the toe portion. Correspondingly, when the forward end of the foot link travels downwardly and rearwardly from an upper, forwardmost location along the guide 36, the heel portion of the user's foot initially lowers at a faster rate than the toe portion. This generally corresponds with the relative motion of the user's heel and toe during cross country skiing, walking, running and climbing or other stepping motions.

Figure 14:
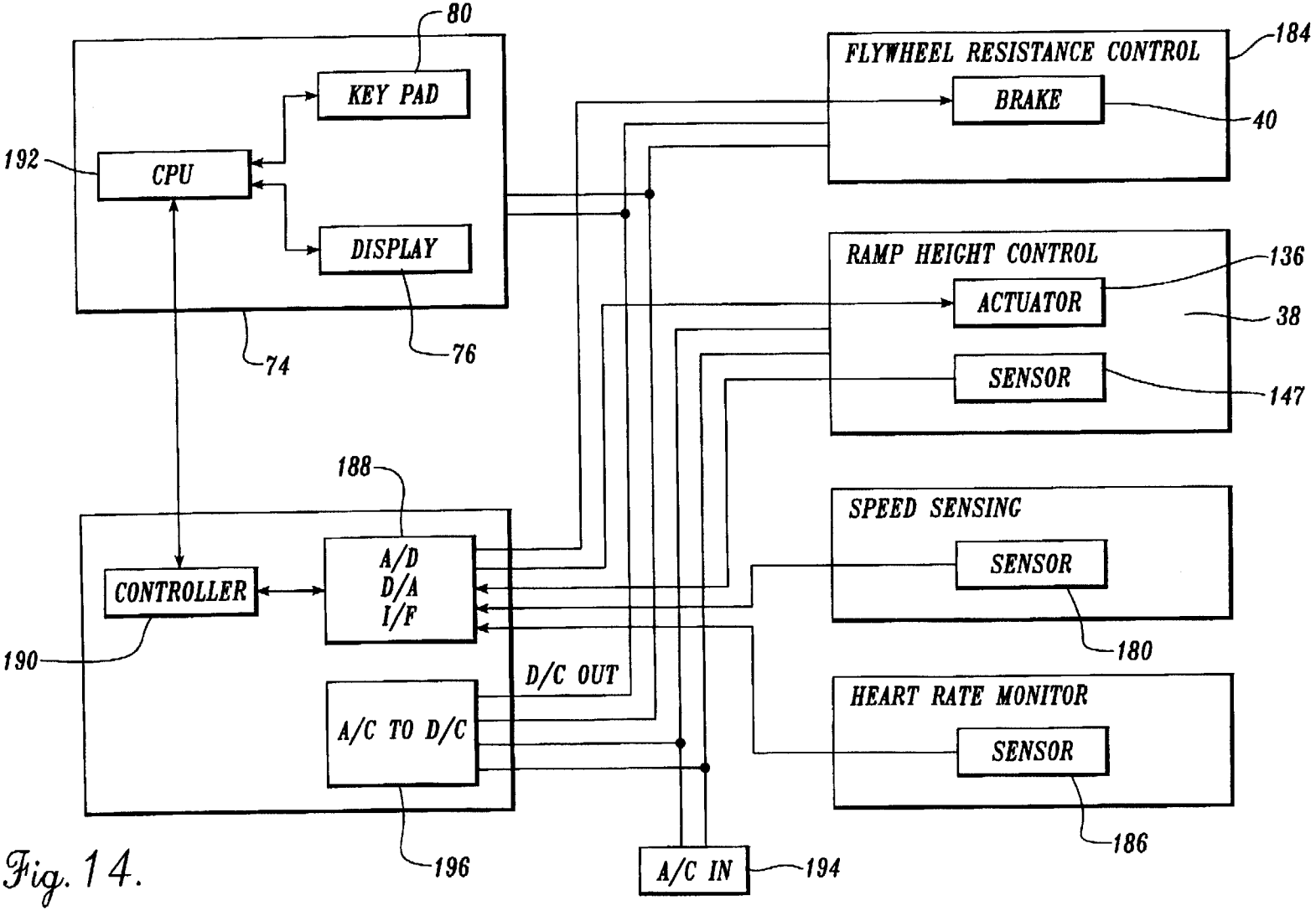
FIG. 14 is a schematic drawing of the system utilized in the present invention for altering the workout level while utilizing the present apparatus; and, FIG. 15 is a side elevations view of a further preferred embodiment of the present invention.

Applicants' system 184 for controlling and coordinating the angle of inclination of the guide 36 and the resistance applied to the rotation of the flywheels **24*a* and 24*b* to achieve a desired workout level is illustrated schematically in FIG. 14. As shown in FIG. 14, a physical workout parameter, e.g., user's heart rate, is monitored by a sensor 186. An electrical signal, typically analog in nature, related to the user's heart rate is generated. Various types of heart rate monitors are available, including chest worn monitors, ear lobe monitors and finger monitors. The output from the monitor 186 is routed through an analog to digital interface 188, through controller 190 and to a central processing unit (CPU) 192, ideally located within display panel 74**. In addition to, or in lieu of, the user's heart rate, other physical parameters of the exerciser may be utilized, including respiratory rate, age, weight, sex, etc.

Continuing to refer to FIG. 14, the exercise control system 184 of the present invention includes an alternating current power inlet 194 connectable to a standard amperage AC 110 volt power supply. The power inlet 194 is routed to a transformer 196 and then on to the brake system 40 and the display panel 74. The lift mechanism 38 utilizes AC power, and thus, is not connected to the transformer 196.

As previously discussed, the lift mechanism 38 incorporates a sensing system 147 to sense the extension and retraction of the lift mechanism, and thus, the angle of inclination of the guide 36. This information is routed through the analog to digital interface 188, through controller 190 and to the CPU 192. The rotational speed of the flywheels 24*a* and 24*b* is also monitored by a sensor 180, as discussed above, with this information is transmitted to the CPU through the analog to digital interface 188 and controller 190. Thus, during use of the apparatus 18 of the present invention, the CPU is apprised of the heart rate or other physical parameter of the exerciser being sensed by sensor 186, the angle of inclination of the guide 36 and the speed of the flywheels 24*a* and 24*b*. This information, or related information, may be displayed to the exerciser through display 76.

Further, through the present invention, a desired workout level may be maintained through the control system 184. For instance, certain parameters may be inputted through the keypad 80 by the exerciser, such as age, height, sex, to achieve a desired heart rate range during exercise. Alternatively, the desired heart rate range may be directly entered by the exerciser. Other parameters may or may not be inputted by the exerciser, such as the desired speed of the flywheels corresponding to cycles per minute of the foot links and/or inclination of the guide 36. With this information, the control system of the present invention will adjust the braking system 40 and/or lift mechanism 38 to achieve the desired workout level.

It is to be understood that various courses or workout regimes may be preprogrammed into the CPU 192 or designed by the user to reflect various parameters, including a desired cardiovascular range, type of stepping action, etc. The control system 184 thereupon will control the brake system 40 as well as the lift mechanism 38 to correspond to the desired workout regime.

Figure 15:
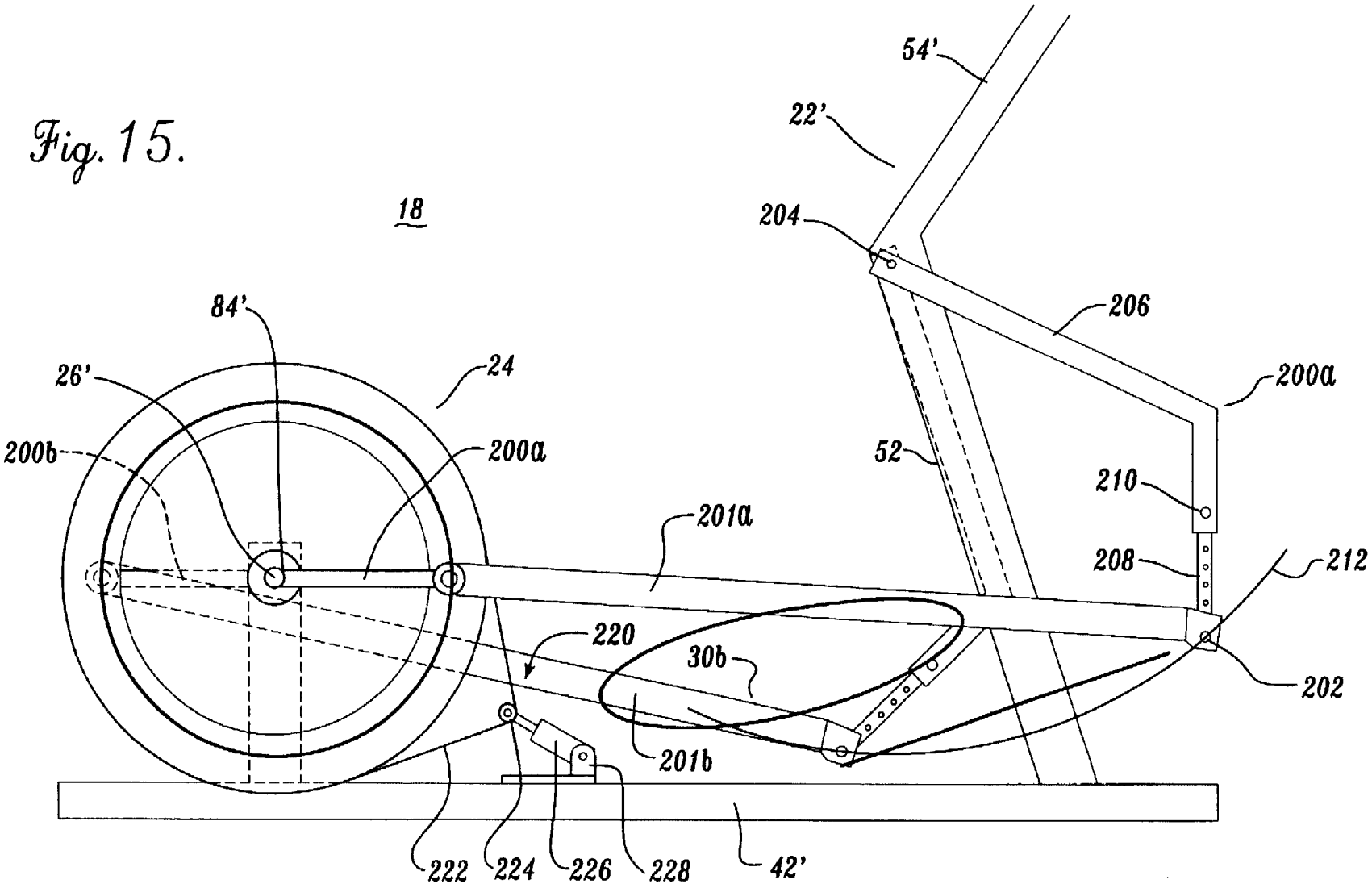

A further preferred embodiment of the present invention is illustrated in FIG. 15. The apparatus 18' shown in FIG. 15 is constructed similarly to apparatus 18 shown in the prior figures. Accordingly, those components of apparatus 18' that are the same as, or similar to, those components of apparatus 18 bear the same part number, but with the addition of the prime (" ' ") designation.

Apparatus 18' includes a single flywheel 24' rotatably mounted at the rear of frame 20'. A pair of crank arms 200*a* and 200*b* extend transversely in diametrically opposite directions from the ends of a drive shaft 84' to pivotally connect to the rear ends of foot links 30*a'* and 30*b'*. The crank arms 200*a* and 200*b* are fixedly attached to the drive shalt 84'. It will be appreciated that the crank arms 200*a* and 200*b* support the rear ends of the foot links 30*a'* and 30*b'* during fore and aft motion thereof. In this regard, the lengths of the crank arms can be altered to change the "stroke" of the foot links to accommodate uses of different leg/inseam lengths.

The forward ends of the foot links 30*a'* and 30*b'* are pivotally pinned to the lower ends of rocker or swing arms 201*a* and 201*b* at pivot joints 202. The swing arms are preferably tubular in construction and dog-leg in shape, having their upper ends pinned to post 22' at axis 204 near the intersection of lower section 52' and upper section 54' of the post. Each of the swing arms includes a tubular upper section 206 and a tubular lower section 208. The upper end portion of the lower section 208 slidably engages within the lower end portion of a corresponding upper section 206, thereby to selectively alter the length of the swing arms. The swing arm upper and lower sections may be maintained in engagement with each other by any convenient means, such as by a cross pin 210 extending through diametrically aligned openings formed in the swing arm upper section and one of the sets of diametrically aligned openings formed in the lower sections.

Although not illustrated, an extension spring or other device may be located with the interior of the swing arm upper and lower sections to bias the upper and lower sections into engagement with each other. Alternatively, the engagement of the swing arm upper and lower sections may be "automatically" controlled by incorporating a linear actuator or other powered device into the construction of the swing arms.

The swing arms 201*a* and 201*b* support the forward ends of the foot links 30*a'* and 30*b'* to travel along an arcuate path 212 defined by the pivot axis 204 of the upper ends of the swing arms about post 22' and the radial length between such axis 204 and the pivot point 202 defining the connection point of the forward end of the foot link and the lower end of its corresponding swing arm. It will be appreciated that the path 212 may be altered as the relative engagement between the swing arm upper section 206 and lower section 208 is changed. This results in a change in the stepping motion experienced by the user, which stepping motion may be altered in a manner similar to that achieved by varying the angle of inclination of guide 36, discussed above. As such, the apparatus 18' is capable or providing the same advantages as provided by the apparatus 18, noted above.

A band brake system 220 is provided to selectively impart rotational resistance on the flywheel 24'. The band brake system includes a brake band 222 that extends around the outer rim of the flywheel 24' and also about a small diameter takeup roller 224 that is rotatably attached to the outer/free end of a linear actuator 226. The opposite end of the linear actuator is pivotally pinned to a mounting bracket 226 attached to frame 42'. It will be appreciated that the linear actuator may be mechanically, electrically or otherwise selectively controlled by the user to impart a desired frictional load on the flywheel 24'. Also, other known methods may be used to impart a desired level of rotational resistance on the flywheel 24'. For instance, a caliper brake (not shown) can be employed to engage against the outer rim portion of the flywheel itself or on a disk (not shown) that rotates with the flywheel.

Figure 16:
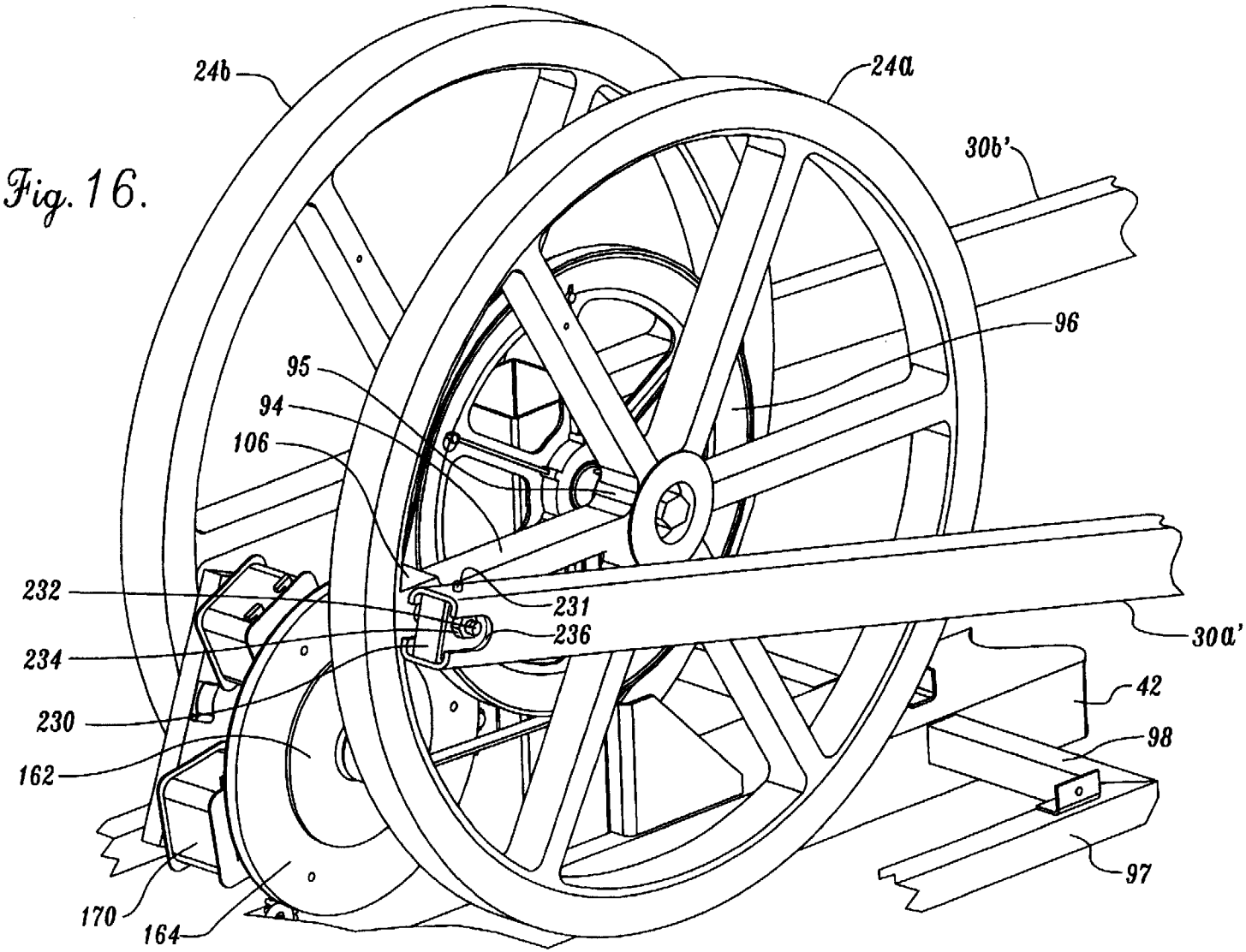
FIG. 16 is an enlarged, partial perspective view of a further preferred embodiment of the present invention.

A still further preferred embodiment of the present invention is illustrated in FIG. 16. Multi-pivoting connections between the foot links 30*a'* and 30*b'* to flywheels 24*a* and 24*b* are provided. A rail pivot block 230 is pivotally pinned to each flywheel 24*a* and 24*b* at apertures 104 by a threaded fastener 232 and mating nut 234. The rail pivot blocks 230 move in a plane approximately parallel to the plane of the corresponding flywheel. Foot links 30a' and 30b' are hollow at the rear ends for receiving the rail pivot blocks 230. A block mounting pin 231 extends through opposing holes on the top and bottom of the rear end of foot links 30a' and 30b' and snugly through a hole in the pivot block for attaching the pivot block 230 to the rear end of the foot links. Slots 236 extend longitudinally from the rear ends of foot links 30a and 30b allow access to the fasteners 232 and 234.

Ideally, the rail pivot blocks 230 are generally rectangular in shape and sized to fit between the upper and lower flange walls of the hollow foot links. However, the internal width of the flange portions of the foot links is wider than the thickness of the rail pivot blocks 230 to allow angular displacement of the foot links relative to pivot block about mounting pin 231, which acts as the pivot point. This construction provides a foot link connection between the flywheels 24a and 24b and guides 36 that compensate for possible inconsistencies in the alignment of the flywheels 24a and 24b as well as the guide 36, especially in the direction transverse to the length of the foot links 30a and 30b. It can be appreciated to one of ordinary skill that varying the thickness of rail pivot blocks 230 and the position of the block mounting pins 231 allow a designer to fine tune the construction depending on expected tolerances that may occur in the alignment of the other components of the present invention.

While preferred embodiments of the present invention have been illustrated and described, it would be appreciated that various changes may be made thereto without departing from the spirit and scope of the present invention.

The embodiments of the invention in which an exclusive property or privilege is claimed are defined as follows:

1. An exercise device to simulate various types of stepping motions, comprising:

a frame having a pivot axis defined thereon, the frame configured to be supported on a floor;

a first and second foot link, each foot link including a first end, a second end and a foot supporting portion therebetween;

a coupling system associated with the first end of each foot link for pivotally connecting the first end of each foot link to the pivot axis so that the first end travels in an arcuate path relative to the pivot axis;

a guide supported by the frame and operative to engage and direct the second ends of the foot links along preselected reciprocating paths of travel as the first ends of the respective foot links travel along arcuate paths of travel, so that when the exercise device is in use and when the second end of one of the foot link travels forwardly from a rearmost position the heel portion of the user's foot initially rises at a faster rate than a toe portion thereof, and when the second end of the foot link travels rearwardly, from a foremost position, the heel portion of the user's foot initially lowers at a faster rate than the toe portion; and, a control system for selectively automatically changing at least one of the elevation and angular orientation of the guide relative to the frame so as to alter the path traveled by the foot supporting portion of the first and second links.

2. The exercise device of claim 1, wherein the guide is disposed at an inclined relationship with the floor, and the guide changing system is operable to alter the inclination of the guide relative to the floor.

3. The exercise device according to claim 2, wherein the guide extends longitudinally relative to the frame and in general alignment with the first and second foot links, and wherein the guide includes means for pivotally attaching the guide to the frame about a pivot axis, and the guide changing system includes means for varying the orientation of the guide relative to the frame about the guide pivot axis.

4. The exercise device according to claim 2, wherein the guide changing system includes means for raising and lowering the guide relative to the frame.

5. The exercise device according to claim 2, wherein the guide comprises first and second tracks, and the guide changing system operably engaging the tracks to alter the orientation of the tracks relative to the frame.

6. The exercise device according to claim 5, wherein the guide changing system operably engaging the tracks to vary the angular orientation of the tracks relative to the frame.

7. The exercise device according to claim 1, wherein the guide is pivotally supported by the frame, and the guide changing system operably engages the guide to raise and lower the guide relative to the frame.

8. The exercise device according to claim 7, wherein the guide includes at least one rocker arm pivotally supported by the frame and pivotally connected to a second end of the first and second links.

9. The exercise device according to claim 8, wherein the guide changing system operably engages the rocker arm to raise and lower the rocker arm relative to the frame.

10. The exercise device according to claim 8, wherein the guide changing system includes means for altering the length of the rocker arm thereby to adjust the elevation of the guide.

11. The exercise device according to claim 1, wherein the coupling system includes first and second wheels rotatably mounted on the frame about the frame pivot axis and means for pivotally connecting the first ends of the first and second foot links to the first and second wheels.

12. The exercise device according to claim 11, wherein the first ends of the first and second foot links are pivotally connectable to the first and second wheels at selective locations relative to the frame pivot axis.

13. The exercise device according to claim 1, further comprising members associated with the first ends of each foot link pivotally for connecting the first ends of the foot links at selective distances from the frame pivot axis to alter the arcuate paths of travel of the first ends of the foot links travel relative to the frame pivot axis.

14. The exercise device according to claim 11, further comprising adjustable resistance means to selectively impart resistance to the rotation of the first and second wheels.

15. The exercise device according to claim 11, wherein said means for pivotally connecting the first ends of the first and second foot links to the pivot axis includes means for angularly displacing the foot links at the connection between the first ends of the foot links and the frame pivot axis.

16. The exercise device according to claim 1, wherein the coupling system includes first and second crank arms, with one end of the crank arms pivotable about the pivot axis and the other ends of the crank arms pivotally pinned to the first end of the first and second foot links.

17. The exercise device according to claim 16, wherein the crank arms are adjustable in length.

18. The exercise device according to claim 1, further comprising adjustable resistance means to selectively impart resistance to the travel of the first ends of the foot links about the pivot axis.

19. The exercise device according to claim 1, further comprising means for connecting the first ends of the foot links at selective distances from the pivot axis.

20. An exercise device to simulate various types of stepping motions, comprising:

a frame configured to be supported on a floor;

flywheel means mounted on the frame to rotate about a pivot axis;

first and second foot links, each foot link having a first end and a second end and a foot support portion therebetween;

means for pivotally coupling the first ends of the foot links to the flywheel means so that the first ends travel in an arcuate path about the pivot axis;

a guide supported by the frame to operably engage and direct the second ends of the foot links along preselected reciprocating paths of travel as the first ends of the respective foot links travel about the pivot axis; and, a control system for selectively automatically altering one of the elevation and angular orientation of the guide relative to the frame so as to alter the path traveled by the foot supporting means of the first and second links.

21. The exercise device according to claim 20, wherein the flywheel means includes a pair of flywheels, and the coupling means coupling the first ends of the foot links to a respective flywheel.

22. The exercise device according to claim 21, wherein the coupling means connecting the first ends of the foot links to selective locations on the flywheels relative to the pivot axis.

23. The exercise device according to claim 20, wherein the coupling means includes first and second crank arms, with one end of the crank arms pivotable about the pivot axis and the other ends of the crank arms pivotally pinned to the first end of the first and second foot links.

24. The exercise device according to claim 23, wherein the crank arms are adjustable in length.

25. The exercise device according to claim 20, wherein the guide is configured to direct the second ends of the foot links along a reciprocating path of travel as the first ends of the foot links travel about the pivot axis so that when the exercise device is in use and when the second ends of the foot links travel from a point at a rearward end of the reciprocating path forwardly along the path, the heel portion of the user's foot associated with the foot link initially rises at a faster rate than the toe portion and when the second end of the foot link travels rearward along the reciprocating path of travel from a forward end of the reciprocating path, the heel portion of the user's foot initially lowers at a faster rate than the toe portion.

26. The exercise apparatus according to claim 20, wherein the guide is configured to direct the second ends of the foot links about a fore and aft path of travel so that when the exercise device is in use and when a foot of a user which is disposed upon the foot support portion of a foot link travels forward, from a rearmost position, the heel portion of the foot initially rises at a faster rate than the toe portion of the foot, and when the foot travels rearward, from a foremost position, the heel portion of the foot initially lowers at a faster rate than the toe portion of the foot.

27. The exercise device according to claim 20, wherein the guide altering system includes means for raising and lowering the guide relative to the frame.

28. The exercise device according to claim 27, wherein the guide is disposed at an inclined relationship to the floor, and the guide altering system is operable to alter the inclination of the guide relative to the floor.

29. The exercise device according to claim 20, wherein the guide is pivotally supported by the frame, and the guide altering system engages the guide to rotate the guide relative to the frame.

30. The exercise device according to claim 20, wherein the guide is pivotally supported by the frame, and the guide altering system operably engages the guide to raise and lower the guide relative to the frame.

31. The exercise device according to claim 30, wherein the guide includes at least one pivot arm pivotally supported by the frame and pivotally connected to the second ends of the first and second links.

32. The exercise device according to claim 31, wherein the guide changing system operably engages the pivot arm to raise and lower the pivot arm relative to the frame.

33. The exercise device according to claim 31, wherein the guide changing system includes means for altering the length of the pivot arm thereby to adjust the elevation of the guide.

34. The exercise device according to claim 20, further comprising a resistance system to selectively impart resistance to the flywheel means.

35. The exercise device according to claim 34, wherein the resistance system includes a brake imparting resistance to the rotation of the flywheel means selected from the group consisting of an eddy current brake, a band brake and a caliper brake.

36. The exercise device according to claim 20, further comprising a resistance system to provide resistance to the travel of the foot links.

37. An exercise device to simulate various types of stepping motions, comprising:

a frame having a pivot axis defined thereon, the frame configured to be supported on a floor;

a first and second foot link, each foot link including a first end, a second end and a foot supporting portion therebetween;

a coupling system associated with the first end of each foot link for pivotally connecting the first end of each foot link to the pivot axis so that the first end travels in an arcuate path relative to the pivot axis, wherein said coupling system includes pivot means for pivotally connecting the first ends of the first and second foot links to the pivot axis, said pivot means allowing laterally angular displacement of foot links at the connection between the first ends and the pivot axis; and a guide supported by the frame and operative to engage and direct the second ends of the foot links along preselected reciprocating paths of travel as the first ends of the respective foot links travel along arcuate paths of travel.

38. The exercise device of claim 37, wherein the pivot means has two orthogonal axes of rotation.

* * * * *

UNITED STATES PATENT AND TRADEMARK OFFICE

CERTIFICATE OF CORRECTION

PATENT NO. : 5,685,804
DATED : November 11, 1997
INVENTOR(S) : J. Whan-Tong et al.

It is certified that error appears in the above-identified patent and that said Letters Patent is hereby corrected as shown below:

| COLUMN | LINE | |
|---|---|---|
| [56] Pg. 1, col. 2 | Refs. Cited (Other Publs.) | "undiscennable" should read --undiscernable-- |
| [57] Pg. 1, col. 2 | Abstract line 5 of text | "to these" should read --of these-- |
| [57] Pg. 1, col. 2 | Abstract line 6 of text | "users" should read --user's-- |
| 2 | 25 | "time" should read --frame-- |
| 3 | 15 | "elevations" should read --elevational-- |
| 3 | 22 | "elevations" should read --elevational-- |
| 3 | 28 | "EMBODIMENTS" should read --EMBODIMENT-- |
| 3 | 37 | "28a and 28b" should read --30a and 30b-- |

UNITED STATES PATENT AND TRADEMARK OFFICE

CERTIFICATE OF CORRECTION

PATENT NO. : 5,685,804
DATED : November 11, 1997
INVENTOR(S) : J. Whan-Tong et al.

It is certified that error appears in the above-identified patent and that said Letters Patent is hereby corrected as shown below:

| COLUMN | LINE | |
|---|---|---|
| 3 | 45 | "carded" should read --carried-- |
| 4 | 40 | "beating" should read --bearing-- |
| 4 | 52 | "comer" should read --corner-- |
| 5 | 16 | After "30*b*" insert --are-- |
| 5 | 55 | "user's" should read --users-- |
| 5 | 56 | "in seams." should read --inseams.-- |
| 6 | 39 | After "138" insert --that-- |
| 6 | 66 | "a eddy" should read --an eddy-- |
| 7 | 36 | "flee" should read --free-- |
| 7 | 61 | "one foot pads" should read --one foot pad-- |
| 9 | 22 | "is transmitted" should read --being transmitted-- |
| 9 | 65 | "shalt" should read --shaft-- |
| 10 | 43 | "capable or" should read --capable of-- |

UNITED STATES PATENT AND TRADEMARK OFFICE

CERTIFICATE OF CORRECTION

PATENT NO. : 5,685,804
DATED : November 11, 1997
INVENTOR(S) : J. Whan-Tong et al.

It is certified that error appears in the above-identified patent and that said Letters Patent is hereby corrected as shown below:

| COLUMN | LINE | |
|---|---|---|
| 11 | 8 | After "30*b*" insert --and-- |
| 11 (Claim 1, | 39-40 lines 6-7) | "ther-ebetween;" should be hyphenated --there-between;-- |
| 11 (Claim 1, | 50 line 17) | "foot link" should read --foot links-- |
| 11 (Claim 1, | 56 line 23) | "a,faster" should read --a faster-- |
| 11 (Claim 1, | 57 line 24) | Before "automatically" insert --and-- |
| 13 (Claim 20, | 17 line 16) | Before "automatically" insert --and-- |
| 14 (Claim 35, | 30-31 lines 4-5) | "brake, a band brake and a caliper brake." should read --brake and a band brake.-- |

UNITED STATES PATENT AND TRADEMARK OFFICE

CERTIFICATE OF CORRECTION

PATENT NO. : 5,685,804
DATED : November 11, 1997
INVENTOR(S) : J. Whan-Tong et al.

It is certified that error appears in the above-identified patent and that said Letters Patent is hereby corrected as shown below:

| COLUMN | LINE | |
|---|---|---|
| 14 (Claim 37, | 41-42 lines 6-7) | "ther-ebetween;" should be hyphenated --there-between;-- |

Signed and Sealed this

Thirtieth Day of May, 2000

*Attest:*

*Attesting Officer*

Q. TODD DICKINSON

*Director of Patents and Trademarks*